US005756006A

United States Patent [19]

Reed, Jr. et al.

[11] Patent Number: 5,756,006

[45] Date of Patent: May 26, 1998

[54] INERT SIMULANTS FOR ENERGETIC MATERIALS

[75] Inventors: Russell Reed, Jr.; Vicki Lynn Brady, both of Ridgecrest, Calif.

[73] Assignee: The United States of America as represented by the Secretary of the Navy, Washington, D.C.

[21] Appl. No.: 351,856

[22] Filed: Dec. 7, 1994

[51] Int. Cl.[6] ..... C06B 45/36

[52] U.S. Cl. ..... 252/408.1; 149/17

[58] Field of Search ..... 149/49.6, 19.4, 149/19.1, 19.92, 19.8, 87, 49.4, 17; 252/408.1

[56] References Cited

U.S. PATENT DOCUMENTS

| | | | |
|---|---|---|---|
| 3,609,115 | 9/1971 | Sammon | 523/180 |
| 3,808,061 | 4/1974 | Pierce | 588/8 |
| 3,811,358 | 5/1974 | Morse | 86/20.1 |
| 3,841,929 | 10/1974 | Craig | 149/17 |
| 3,951,706 | 4/1976 | Eldridge | 149/19.8 |
| 4,001,058 | 1/1977 | Hawthorne | 149/22 |
| 4,029,529 | 6/1977 | Elrick et al. | 149/19.6 |
| 4,755,310 | 7/1988 | Mori et al. | 252/49.6 |
| 4,976,794 | 12/1990 | Biddle et al. | 149/19.5 |
| 5,071,499 | 12/1991 | Torres | 149/109.4 |
| 5,205,983 | 4/1993 | Camp et al. | 149/97 |
| 5,218,166 | 6/1993 | Schumacher | 102/431 |
| 5,441,560 | 8/1995 | Chiotis et al. | 106/18.12 |
| 5,600,089 | 2/1997 | Reed et al. | 149/19.4 |

OTHER PUBLICATIONS

Text. Res. Journal (1975) vol. 45, No. 6 pp. 474–483, Flame–retarded Nylon Carpets by Stoddard et al. As Abstracted by Chemical Abstract 1975:499008.

*Primary Examiner*—Sharon Gibson
*Assistant Examiner*—Valerie Fee
*Attorney, Agent, or Firm*—Stephen J. Church; Melvin J. Sliwka

[57] ABSTRACT

A substantially inert composition has mechanical properties simulating corresponding properties of an energetic composition which may include a nitrate ester and may include a particulate organic energetic filler. A nitrate ester is replaced by a mixture of inert materials having densities less than and more than the density of the ester and present in proportions such that the mixture has substantially the density of the ester. A particulate energetic organic filler is replaced by a particulate inert organic chlorine derivative having substantially the same density. When the ester is 1,2,4-butanetriol trinitrate, which may function as a plasticizer in an elastomeric energetic composition, the less dense material is a non-volatile ester, such as dimethyl phthalate, and the more dense material includes a bromoaromatic derivative as in a mixture of pentabromodiphenyl ether and an aryl phosphate. When the particulate energetic organic material includes the energetic particulate material cyclotetramethylenetetranitramine the chlorine derivative is 1,2,3,4,7,8,9,10,13,14,14-dodecachloro-,1,4,4a,5,6,6a,7,10,10a,11,12,12a-dodecahydro-1,4,7,10-dimethanodibenzo (a,e) cyclooctene. With this chlorine derivative, the inert composition may include particulate aluminum in about the same proportion as the energetic composition.

13 Claims, No Drawings

INERT SIMULANTS FOR ENERGETIC MATERIALS

BACKGROUND OF THE INVENTION

1. Field of the Invention

This invention pertains to the field of inert compositions having mechanical properties simulating corresponding properties of energetic compositions that incorporate nitrate esters and particulate energetic fillers.

2. Description of the Prior Art

Inert compositions having substantially the same mechanical and physical properties as energetic compositions used as propellants and explosives are highly desired for use in testing the safety of missiles and the like which are loaded with the energetic compositions for actual use and may be subject to mechanical damage. Specimens of the compositions and assemblies containing them are subjected to drop tests, air gun tests, and the like to determine the response of the compositions to given levels of mechanical energy input since the relationship between mechanical energy absorbed and damage to energetic materials is important in predicting the response of the materials to a given energy input and for use in designing such materials and devices incorporating them.

It is evident that such tests with an energetic composition that result in its initiation destroy the composition and any associated hardware so that it is impossible to inspect a damaged composition specimen and hardware for determination of the effect of predetermined mechanical energy input to the composition for correlation with other tests such as fracture tests of the composition. While relatively insensitive energetic materials, typically elastomeric, have been developed they cannot be truly inert and must be tested, and is also evident that remote and expensive facilities are required for such tests of large ordnance items that might detonate or deflagrate.

For effective simulation of energetic compositions by inert compositions the general nature of the compositions must be the same. It is evident that, for mechanical properties such as maximum stress and elongation, stress/strain relation, and fracture characteristics to be similar in two compositions, physical properties such as density and characteristics such as elastomer binder or backbone structure and particle sizes must be very similar in the compositions. Further, if the energetic composition is an elastomer having a binder and energetic nitrate ester plasticizer, the simulant must have a binder with similar properties as well as an inert plasticizer having the same density and plasticizing effect as the nitrate ester. Additionally, the inert plasticizer, when associated with the simulant binder must have effectively the same bonding to particulate fillers as the nitrate ester, a requirement complicated by the further requirement that any particulate filler used in the simulant must be inert—at least as incorporated in the simulant—and yet have effectively the same density and be used in substantially the same relative amount as a corresponding filler in an energetic composition so that the plasticizer and particulate of the simulant will have the same kind and amount of damage when subjected to mechanical damage as the corresponding materials of the energetic composition.

The problem is further complicated by the fact that particulate fillers of energetic compositions commonly include, in various amounts and a mixture of sizes, an organic material such as cyclotetramethylenetetranitramine (HMX), ammonium perchlorate (AP), and a metal, typically, aluminum. For effective simulation of mechanical properties an inert composition must not only have a corresponding number of particulates, but these particulates must be provided in substantially the same particle sizes or mixtures of sizes. A further problem is that an inert simulant composition must not only have the properties of a target energetic composition when the target composition is in its state, such as solid or elastomeric, for use; but the inert composition must also have substantially the same Theological properties as the target composition during preparation, as when an uncured liquid or semi-solid, so as to be capable of being formed by the same process—such as extrusion, casting, and injection loading used to form the target composition. Also the curing times of a simulant must permit preparation of suitable samples.

In particular, there has heretofore been no inert plasticizer available to substitute for a nitrate ester plasticizer even though inert plasticizers having storage characteristics unsuitable for an actual ordnance device are useable for tests. Specifically, no plasticizer has been found that is effectively as dense as typical energetic plasticizers, such as 1,2,4-butanetriol trinitrate (BTTN); that does not interfere with the curing of desirable binders—such as polyalkylene oxide (PAO)/polyethylene glycol (PEG) binders which are very effective in high elongation propellants; and that does not produce a binder with separate phases. For examples, dimethyl phthalate (DMP) is an excellent plasticizer for PAO binders but is less dense than BTTN, and fluorine and chlorine derivatives are more dense than BTTN and are also incompatible with a binder plasticizer system of PAO and DMP. Other materials, such as nitrites, may be effective plasticizers/but have deficiencies such as toxicity.

Historically, inorganic salts are used in inert simulants in place of the commonly used energetic particulate filters HMX, density 1.90 g/cc, and AP, density 1.95 g/cc. For example, KCl has density of 1.98 g/cc which is close to that of HMX and AP. However, KCl agglomerates after grinding to 10 μm, a typical particulate size for this purpose, as well as being ionic and thus not simulating the binder/HMX interaction. $CaCO_3$ does not agglomerate but has too high a density, 2.93 g/cc, and gives mixtures with excessive viscosity. Other salts are also too dense and have other deficiencies resulting in undesirable mechanical properties.

A final problem in providing inert compositions with properties effectively simulating energetic compositions is that no substitute has been found for aluminum metal in particulate form, since no less active metal has similar density and conductivity. This problem is complicated by the fact that aluminum may react with an otherwise inert halogen containing plasticizer or particulate filler.

SUMMARY AND OBJECTS OF THE INVENTION

The present invention provides effectively, inert compositions having properties, such as density, maximum tensile stress, elongation, viscosity and fracture characteristics which are similar to corresponding properties of energetic compositions which may include a nitrate ester and may include particulate energetic fillers which may be organic and may also include metals.

Such a nitrate ester is replaced by a mixture of inert materials having densities less than and more than the density of the nitrate ester and present in proportions such that the mixture has substantially the density of the nitrate ester. The nitrate ester may function as a plasticizer in an elastomeric energetic composition, and the less dense material in the inert composition is then a non-volatile ester while the more dense material includes a bromaromatic derivative. When the nitrate ester and plasticizer is 1,2,4-butanetriol trinitrate, the less dense material is dimethyl phthalate and the more dense material is a mixture of pentabromodiphenyl ether and an aryl phosphate.

Such a particulate energetic organic filler is replaced by a particulate inert organic chlorine derivative having substantially the same density. When the particulate energetic organic material includes cyclotetramethylenetetranitramine, a suitable particular chlorine derivative is 1,2,3,4,7,8,9,10,13,14,14-dodecachloro,-1,1,4,4a,5,6,6a,7,10,10a,11,12,12a-dodecahydro-1,4,7,10 dimethanodibenzo (a,e) cyclooctene previously utilized as a flame retardant and flare color enhancer. Inert compositions of the present invention may include particulate aluminum in about the same proportion as in a corresponding energetic composition.

It is an object of the present invention to provide substantially inert compositions having mechanical and physical properties similar to the corresponding properties of energetic propellant and explosive compositions.

Another object to provide such inert compositions effectively simulating these properties of such energetic compositions including any combination of liquid nitrate esters, particulate organic fillers, and particulate metal fillers.

An additional object is to provide such inert compositions having substantially the same rheological properties during processing as a corresponding energetic composition.

A further object is to provide such inert compositions simulating such energetic compositions which are elastomers having liquid nitrate esters as plasticizers.

Yet another object is to provide materials providing inertness in such inert compositions incorporating the same particulate metals and amounts thereof used in corresponding energetic compositions.

A still further object is to provide such inert compositions which are economical, conveniently processed, non-toxic, and fully effective.

DETAILED DESCRIPTION

In the following examples, the materials and mixing and curing procedures are, in general, all well known in the energetic material and elastomer arts and common acronyms, which are identified herein, are used for the materials. However, certain of the materials are now particularly identified and discussed. "PAO 24-13" is a tradename for a tetrastar polyethylene oxide polyol which has a functionality of four and is available from BASF Wyandotte, Wyandotte, Mich. and having the -formula $C[CH_2O(CH_2CH_2O)_m(CH_2C(CH_3)HO)_n(CH_2CH_2O)_oH]_4$ and a equivalent weight of about 4500 daltons, "PAO" being an acronym for polyalkylene glycol.

"Dechlorane" is a tradename for a granular chlorine derivative available from Occidental Chemical Corp., Dallas, Tex. This material is a chlorinated tricyclic hydrocarbon compound, 1,2,3,4,7,8,9,10,13,14,14-dodecachloro-1,4,4a,5,6,6a,7,10,10a,11,12,12a-dodecahydro-1,4,7,10-dimethanodibenzo (a,e) cyclooctene. This material is used as a flame retardant, smoke source, and color enhancer in pyrotechnics, and is used in large quantities as a fire retardant in such electrical equipment as wire and cable insulation and connectors constructed of nylon material.

Any appropriate curative may be used for inert compositions of the present invention including the well-known curatives hexamethylene diisocynate (HDI) and its biuret trimer. "DE-60" and "DE-62" are trade names for plasticizers available from Great Lakes Chemical Co., Lafayette, Ind. and are relatively dense (1.9 g/cm$^3$),mixtures of pentabromodiphenyl ether and aryl phosphate esters, the DE-62 plasticizer having a lower acid content.

Any suitable catalyst may be used in appropriate amounts with compositions of the present invention; however, triphenylbismuth (TPB) is, typically, used due to its contribution to extended pot life when activated by dinitrosalicylic (DNSA) acid to produce the actual catalyst in situ.

In the inert compositions of the present invention, aluminum did not require replacement since no evidence of aluminum activity was found with the halogen containing plasticizers as shown by safety tests involving impact, friction, and exposure to flame. It is believed that this is due to such activity being difficult to initiate in presence of the polyalkylene oxide binder and dimethyl phthalate plasticizer. Spherical aluminum particles are effective to enhance the processibility of compositions of the present invention.

It is to be understood that "inert" in reference to all possible compositions in accordance with the present invention does not mean that the compositions are completely inert in the sense that they will not even burn, but only that these compositions will not detonate or deflagrate and are otherwise suitable for simulating the physical and mechanical properties of compositions which are undesirably energetic for many tests. However when exposed to open flame, the inert compositions of the following examples do not burn, but only melt.

In an inert composition of the present invention having an aluminum filler, the proportion of aluminum, density 2.7 g/cc, may be increased somewhat over that of the corresponding energetic composition to adjust for the inert chlorinated tricyclic hydrocarbon filler compound having a somewhat less density, 1.84 g/cc, than that of a substituted for energetic filler such as HMX, density 1.9 g/cc.

EXAMPLE I

A flexible explosive composition, which has mechanical properties simulated by the immediately following inert composition of the present invention, has the following formulation in parts by weight with a plasticizer/binder ratio (Pl/Po) of 5 to provide sufficient flexibility that, when the composition is disposed in a cylindrical, rope-like configuration of 0.3 inch diameter, the composition has a bend radius of less than ¼ inch without cracking or breaking:

| | |
|---|---|
| binder, "PAO 24-13", & curative | 5.543 |
| plasticizer, BTTN | 29.167 |
| n-methyl-p-nitroaniline (MNA) stabilizer | 0.291 |
| HMX particulate filler (6 μm) | 55.000 |
| aluminum particulate filler, Spherical 5 μm | 10.000 |

the curative being the biuret trimer of hexamethylene diisocyanate and present in an amount such that the NCO/OH equivalent ratio is about 2.5 as, typically, necessary with a nitrate ester plasticizer which tends to inhibit cross linking. The above-identified TPB/DNSA catalyst was used.

| | |
|---|---|
| density, g/cc, | 1.764 |
| maximum stress at 2 in/min, psi | 180 |
| elongation, at 2 in/min, % | 970 |
| maximum stress at 16524 in/min, psi | 171 |
| elongation, at 16524 in/min, % | 970 |

An inert composition in accordance with the present invention for simulating the mechanical properties of the above explosive composition also provides a bend radius of less than ¼ inch for a cylinder of 0.3 inch diameter and has the following formulation in parts by weight:

| | |
|---|---|
| binder "PAO 24-13" | 5.663 |
| curative, hexamethylene diisocynate (HDI) | 0.145 |
| plasticizer, | |
| DMP | 15.838 |
| "DE-62" | 13.329 |
| "Dechlorane 515", particulate filler (average 9–11 μm) | 50.000 |
| aluminum particulate filler, spherical 5 μm | 15.000 |

In this composition, the difunctional curative, which is preferable in inert compositions containing a tetrafunctional binder and a non-volatile and non-energetic ester plasticizer, is present in an amount providing a NCO/OH equivalent ratio in a range of about 1.3 to about 1.5. The DE-62 plasticizer may also inhibit complete urethane formation since some excess of isocynate is required. The less dense dimethyl phthalate (DMP), 1. 1 g/cm$^3$, and the more dense, 1.9 g/cm$^3$, "DE-62" mixture of brominated diphenyl ether and aryl phosphate esters were blended to achieve the BTTN density of 1.52 g/cm$^3$). While the boiling point, freezing point, and slow loss by evaporation of DMP are not suitable for tactically used energetic materials, these properties are satisfactory for a simulant and the carbomethyoxy groups of DMP make it an effective plasticizer by enhanced ability to dissolve the oxygen rich polyether backbone of this binder; and bromoaromatic ethers are sufficiently polar, especially in the presence of an aryl phosphate ester and DMP, to be compatible with the PAO binder. The Dechlorane, density 1.82 g/cm$^3$, was used as the inert filler to replace HMX, density 1.9 g/cm$^3$. The TPB/DNSA catalyst was used. This inert simulant composition has the following properties:

| | |
|---|---|
| density, g/cc, | 1.761 |
| maximum stress at 2 in/min, psi | 126 |
| elongation, at 2 in/min, % | 876 |
| maximum stress at 16524 in/min, psi | 132 |
| elongation, at 16524 in/min, % | 940 |

which have been found satisfactory for simulation of the corresponding properties of the above-described flexible explosive composition including the suitability thereof for injection loading.

EXAMPLE II

A propellant composition, which has mechanical properties simulated by an inert composition in accordance with the present invention, has a trifunctional polyethylene polyurethane binder, a nitrate ester plasticizer, and particulate fillers including a nitramine, ammonium perchlorate and aluminum. This propellant composition has the following properties:

| | |
|---|---|
| density, g/cc, | 1.84 |
| stress at break 17,200 in/min, psi | 136 |
| elongation at break at 17,200 in/min, % | 240 |
| work at 17,200 in/min, in-lbs/in$^3$ | 340 |

The "work" being the area under the stress/strain curve and a measure of the toughness of the composition.

An inert composition for simulating the mechanical properties of the above propellant in accordance with the present invention, has the following formulation in parts by weight:

| | |
|---|---|
| Binder "PAO 24-13" | 6.987 |
| Curative, | 0.416 |
| Plasticizer, DMP + "DE-60F" mixed to give 1.60 g/cc | 19.782 |
| "Dechlorane" particulate filler | |
| "515" (average 9–11 μm) | 48.5 |
| "35" (≧2 μm) | 1.5 |
| aluminum particulate filler, spherical | |
| 60 μm | 16.150 |
| 95 μm | 6.650 |

In this simulant, the biuret trimer of hexamethylene diisocyanate is used as the curative to provide an NCO/OH ratio of 1.37 which provided optimum properties as contrasted to 2.5 required for propellants with PAO binder and nitrate ester plasticizer.

The discussion above, as that of Example I, in regard to functionality of the curative and NCO/OH ratio, the ratio of the less dense DMP and the more dense mixture of brominated diphenyl ether and aryl phosphate esters mixed to achieve the nitrate ester density, suitability of DMP and bromoaromatic ethers, and substitution of a chlorinated tricyclic hydrocarbon compound for nitramine filler and ammonium perchlorate applies also to this Example II inert simulant composition which has the following properties:

| | |
|---|---|
| density, g/cc, | 1.80 |
| stress at break at 17,200 in/min, psi | 100 |
| elongation at break at 17,200 in/min, % | 260 |
| work at 17,200 in/min, in-lbs/in$^3$ | 275 |

Although this inert composition may contain partially bonded solids which may result in relatively lower tensile stress at lower strain rates, these properties have been found satisfactory for simulation of the corresponding propertites of the above-described propellant composition.

Obviously, many modifications, and variations of the present invention are possible in light of the above teachings and examples illustrating but not limiting the present invention. It is, therefore, to be understood that the present invention may be practiced within the scope of the following claims other than as described herein.

What is claimed is:

1. A substantially inert simulant composition having mechanical properties simulating mechanical properties of an energetic composition including a predetermined nitrate ester, said simulant composition comprising a mixture of a first inert material having a density less than the density of said nitrate ester and a second inert material having a density greater than the density of said nitrate ester, said first inert material and said second inert material being present in said mixture in proportions such that said mixture has substantially the same density as said nitrate ester, said predetermined nitrate ester being 1,2,4-butanetriol trinitrate and said first inert material being dimethyl phthalate and said second inert material being a mixture consisting substantially of pentabromodiphenyl ether and an aryl phosphate.

2. A substantially inert simulant composition having mechanical properties simulating mechanical properties of an energetic composition including a predetermined nitrate ester, said simulant composition comprising a mixture of a first inert material having a density less than the density of said nitrate ester and a second inert material having a density greater than the density of said nitrate ester, said first inert material and said second inert material being present in said mixture in proportions such that said mixture has substantially the same density as said nitrate ester, said predetermined nitrate ester functioning as a plasticizer for the energetic composition and said first inert material and said second inert material functioning as plasticizers in said inert simulant material, and said first inert material being a non-volatile ester and said second inert material including a bromoaromatic derivative.

3. The inert simulant composition of claim 2 wherein said predetermined nitrate ester is 1,2,4-butanetriol trinitrate, said first inert material is dimethyl phthalate, and said second inert material is a mixture consisting substantially of pentabromodiphenyl ether and an aryl phosphate.

4. A substantially inert simulant composition having mechanical properties simulating mechanical properties of an energetic composition having a particulate energetic filler including a predetermined particulate organic energetic material, said inert simulant composition comprising a particulate inert organic chlorine derivative having a density substantially equal to the density of said predetermined particulate energetic material, wherein said predetermined particulate energetic material includes cyclotetramethylenetetranitramine; and wherein said particulate inert organic chlorine derivative is 1,2,3,4,7,8,9,10,13,14,14-dodecachloro- 1,4,4a,5,6, 6a,7,10,10a,11,12,12a-dodecahydro-1,4,7,10-dimethanodibenzo (a,e) cyclooctene.

5. The inert simulant composition of claim 4 wherein said particulate energetic filler further includes particulate aluminum metal, and wherein said inert simulant composition further comprises particulate aluminum metal.

6. A substantially inert simulant composition having mechanical properties simulating mechanical properties of an energetic composition including a predetermined nitrate ester and a filler of a predetermined particulate energetic material, said inert simulant composition comprising:

a mixture of a first inert material having a density less than the density of said nitrate ester and a second inert material having a density greater than the density of said nitrate ester, said first inert material and said second inert material being present in said mixture in proportions such that said mixture has substantially the same density as said nitrate ester; and a particulate inert organic chlorine derivative having a density substantially equal to the density of said predetermined particulate energetic material, wherein:

said predetermined nitrate ester is 1,2,4-butanetriol trinitrate, and said predetermined particulate energetic material includes cyclotetramethylenetetranitramine;

said first inert material is dimethyl phthalate and said second inert material is a mixture consisting substantially of pentabromodiphenyl ether and an aryl phosphate;

and said particulate inert organic chlorine derivative is 1,2,3,4,7,8,9,10,13,14,14-dodecachloro-1,4,4a,5,6, 6a,7, 10, 10*a*, 11,12,12a-dodecahydro-1,4,7, 10-dimethanodibenzo (a,e) cyclooctene.

7. The inert simulant composition of claim 6 wherein said particulate energetic filler further includes particulate aluminum metal, and wherein said inert simulant composition further comprises particulate aluminum metal.

8. A substantially inert simulant composition having mechanical properties simulating mechanical properties of an energetic composition including a predetermined nitrate ester and a filler of a predetermined particulate energetic material, said inert simulant composition comprising:

a mixture of a first inert material having a density less than the density of said nitrate ester and a second inert material having a density greater than the density of said nitrate ester, said first inert material and said second inert material being present in said mixture in proportions such that said mixture has substantially the same density as said nitrate ester; and a particulate inert organic chlorine derivative having a density substantially equal to the density of said predetermined particulate energetic materials, said energetic composition and said inert simulant composition being elastomeric, said predetermined nitrate ester functioning as a plasticizer in said energetic composition, said first inert material and said second inert material functioning as plasticizers in said inert simulant composition, and said first inert material being a non-volatile ester and said second inert material including a bromoaromatic derivative.

9. The inert simulant composition of claim 8 wherein said predetermined nitrate ester is 1,2,4-butanetriol trinitrate, said first inert material is dimethyl phthalate, and said second inert material is a mixture consisting substantially of pentabromodiphenyl ether and an aryl phosphate.

10. The inert simulant composition of claim 8 wherein said particulate energetic filler further includes particulate aluminum metal, and wherein said inert simulant composition further comprises particulate aluminum metal.

11. An inert simulant composition having mechanical properties simulating mechanical properties of an energetic composition including a nitrate ester and a particulate energetic filler, said inert simulant composition comprising:

a mixture of a first inert material having a density less than the density of said nitrate ester and a second inert material having a density greater than the density of said nitrate ester, said first inert material and said second inert material being present in said mixture in proportions such that said mixture has substantially the same density as said nitrate ester; and a particulate, inert, chlorinated tricyclic hydrocarbon having a density substantially equal to the density of said particulate energetic filler, wherein said energetic composition is elastomeric and has said nitrate ester as a plasticizer, wherein said inert simulant composition is elastomeric and wherein in said inert simulant composition said first inert material and said second inert material function as plasticizers, said first inert material being an ester and said second inert material including a brominated ether.

12. The inert simulant composition of claim 11 having mechanical properties of said energetic composition in which said nitrate ester is 1,2,4-butanetriol trinitrate and in which said particulate energetic filler includes cyclotetramethylenetetranitramine, wherein in said inert simulant composition said first inert material is dimethyl phthalate, said second inert material is a mixture consisting substantially of pentabromodiphenyl ether and an aryl phosphate, and said particulate, inert, chlorinated tricyclic hydrocarbon is 1,2,3,4,7,8,9,10,13,14,14-dodecachloro- 1,4, 4a,5,6,6a,7,10,10a,11,12,12a-dodecahydro-1,4,7,10-dimethanodibenzo (a,e) cyclooctene.

13. The inert simulant composition of claim 11 having mechanical properties of said energetic composition further including particulate aluminum metal, wherein said inert simulant composition further comprises particulate aluminum metal.

* * * * *